United States Patent [19]

Schneider

[11] Patent Number: 4,838,487

[45] Date of Patent: Jun. 13, 1989

[54] DEVICE FOR ATOMIZING LIQUID PAINT

[75] Inventor: Rolf Schneider, Burgstetten, Fed. Rep. of Germany

[73] Assignee: BEHR Industrieanlagen GmbH & Co., Fed. Rep. of Germany

[21] Appl. No.: 205,151

[22] Filed: Jun. 10, 1988

[30] Foreign Application Priority Data

Jun. 12, 1987 [DE] Fed. Rep. of Germany ... 8708312[U]

[51] Int. Cl.[4] ..... B05B 3/10

[52] U.S. Cl. ..... 239/223; 239/224

[58] Field of Search ..... 239/223, 224, 699, 700, 239/701, 702, 703

[56] References Cited

U.S. PATENT DOCUMENTS

| | | | |
|---|---|---|---|
| 4,643,357 | 2/1987 | Culbertson et al. | 239/223 X |
| 4,760,965 | 8/1988 | Schneider | 239/701 |
| 4,776,520 | 10/1988 | Merritt | 239/700 |

FOREIGN PATENT DOCUMENTS

| | | | |
|---|---|---|---|
| 2336183 | 8/1977 | France | 239/703 |

*Primary Examiner*—Andres Kashnikow

*Assistant Examiner*—Patrick N. Burkhart

*Attorney, Agent, or Firm*—Wigman & Cohen

[57] ABSTRACT

Device for the atomization of liquid paints, includes an atomizer bell and a coaxial centrally perforated deflecting member. The transition surface of the bell cooperates with the axially rear surface and the radially outer surface of the deflecting member to form the boundaries of a chamber in the form of a gap between the bell and the deflecting member, which chamber has only localized interruptions in the form of spacers between the bell and the deflecting member in which the axially rear surface of the deflecting member and the base part of the transition surface facing said rear surface each have an obtuse angled step in cross-section. The step is so arranged that while preserving the gap in a middle section the paint in this gap flows both axially forwards and radially outwards, and the axially rearwardly projecting center of the axially rear surface of the deflecting member is bounded at its radially outer region by a sharp deflecting edge of the step of this rear surface, while the other bends in the cross-sections of the two complementary steps are rounded off.

4 Claims, 1 Drawing Sheet

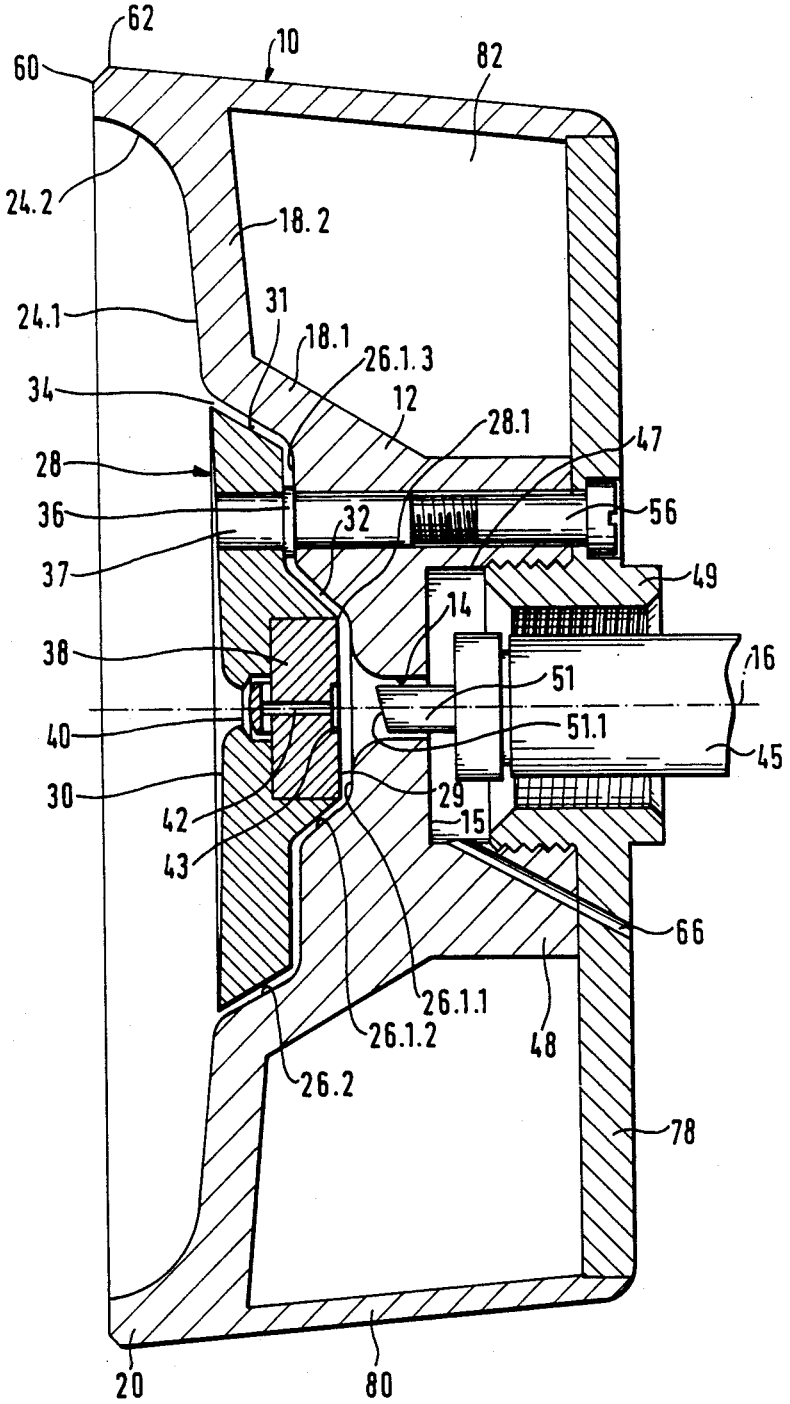
62
10
60
82
24.2
18.2
24.1
31
18.1
26.1.3
34
12
28.1
47
28
36
32
56
37
49
14
38
16
51
40
51.1
45
30
29
42
15
43
66
26.1.1
26.1.2
48
26.2
78
20
80

DEVICE FOR ATOMIZING LIQUID PAINT

BACKGROUND OF THE INVENTION

This invention relates to a device for atomizing liquid paint, comprising an atomizer bell which is rotatable about a central axis and which has an axial opening at its base and an axially forwardly and radially inwardly directed profiled, annular, coaxial overflow surface whose radially inner edge is connected with the axially front edge of the opening by a profiled, annular, coaxial transition surface which forms the axially front boundary to the base; and comprising a coaxial, centrally perforated deflecting member which lies with the centre of its axially near surface facing the coaxial front end of the opening of the bell while its radially outer edge cooperates with the bell to form an annular gap which interrupts the transition from an axially front surface of the deflecting member to the overflow surface of the bell, the transition surface of the bell cooperating with the axially rear surface and the radially outer surface of the deflecting member to form a chamber in the form of a gap between the bell and the deflecting member, which chamber has only localised interruptions formed by axial spacers between the bell and the deflecting member.

In devices of this type disclosed in De-U-82 24 329 and DE-A-35 09 874, the base of the transition surface of the bell and the axially opposite rear surface of the deflecting part facing said transition surface are flat and the part of the transition surface of the bell which forms the gap as well as the radially opposite marginal surface of the deflecting member are conically formed in such a manner that the gap between the bell and the deflecting member has the form of an air chamber which is trapezoidal in axial section passing through the centre apart from the interruptions formed by the spacers, which trapezoidal chamber is alternately filled with paint and liquid rinsing agent for removing paint residues when the paint is to be changed or for performing the final cleaning of the device when the device is to be put out of action for some time.

In the device known from De-U-82 24 329, metal pigments in the liquid paint are liable to agglomerate in the gap between the bell and the deflecting member from which they cannot be adequately removed simply by rinsing out the residues of paint. The device known from DE-A-35 09 874 overcomes this disadvantage by providing localized anomalies in the width of the gap which automatically ensure that deposits from the paint to be atomized, in particular agglomerations of metal pigment or other pigment deposits, cannot settle in the gap or at least will be rinsed out. It has been found in practice, however, that even with such anomalies distributed in a particular manner in the gap, deposits of paint still accumulate and are difficult to remove.

SUMMARY AND OBJECTS OF THE INVENTION

It is therefore an object of the present invention to provide a device of the type defined above with improved flow of paint in the space formed by the gap between the bell and the deflecting member of the device and more efficient rinsing of this space in the device.

To solve this problem according to the invention, the axially rear surface of the deflecting member and the base of the transition surface facing this rear surface each have an obtuse angled step in cross-section, which step is so arranged, while maintaining the gap, that the paint flows both forwards in an axial direction and outwards in a radial direction in a central section of this gap; and the axially rearwardly projecting centre of the axially rear surface of the deflecting member is limited at its radially outer boundary by a sharp deflecting edge of the step of this rear surface while the other bends in the cross-sections of the two complementary steps are rounded off. This has the advantageous effect that as the paint flows in a radial stream on the centre of the axially rear surface of the deflecting member, the sharp deflecting edge of this surface subdivides the paint into partial streams flowing along the envelopes of cone surfaces with different opening angles, and in the central section of the gap between the deflecting member and the bell these partial streams encounter areas where paint deposits previously occurred most frequently. The invention thus produces a controlled self-cleaning action with local differences in a device of the type defined above.

In a preferred embodiment of the device according to the invention, which, in common with the device according to DE-U-82 24 329 (FIG. 1) has a nozzle with a plane end face producing a narrow cone jet, the axially front end of which nozzle extends coaxially into the opening at the base of the bell, which opening is in the form of a bore whch widens out convexly in cross-section in the axially forward direction, the invention now advantageously provides that the centre of the axially rear surface of the deflecting member has a circular, preferably sharp edged recess the axial length of which is substantially less than its diameter; and that the end face of the nozzle makes an angle other than a rightangle, preferably 75° with the central axis. The shallow recess and the oblique end face together produce the effect that that part of the paint jet which issues from the nozzle in a direction parallel to the axis is not reflected back to too great an extent to the oblique end face of the nozzle to be again reflected from there, and a partial stream of the paint reaches the centre of the axial rear surface of the deflecting member at a point radially outside the recess while another partial stream of the paint reaches the trumpet-shaped, axially front end section of the bore in the base of the bell, and these partial streams reunite in the region of the sharp deflecting edge round the central region. These measures also improve the movement of paint in the device and substantially improve the efficiency of rinsing the device.

In the preferred embodiment, in which the atomizer bell is similar to the known devices in having a bottom part with an axial opening and the base part of the transition surface, followed by a ring with the gap part of the transition surface and an annular lip with the axially most forward and radially outermost part of the overflow surface, a conical jacket slightly converging rearwardly is now formed on the back of the lip to extend axially backwards and end axially behind the base. This jacket, which is approximately in the form of a circular cylinder, in particular encloses the bell ring, which is hitherto given a conical construction with the result that, as the radially outer part of the bell, it produced too much divergence of the axially oncoming directing air. The jacket which is now provided can steer the airflow in the desired direction, regardless of the form of the bell ring. This means that the jacket of the bell enables the bell to be given a suitable cross-sectional shape, for example with its overflow surface between lip and deflecting member having a relatively large dimension in the radial direction without the weight of the bell ring necessarily increasing since it is possible to form a radial cavity between the jacket on one side and the base of the bell and part of the bell ring on the other, which cavity may be closed at the back (viewed in the axial direction) by means of an annular disc so that directing air cannot enter the cavity.

The invention will now be described in detail with reference to the drawing showing by way of example a preferred embodiment of the device according to the invention.

BRIEF DESCRIPTION OF THE DRAWING

The single FIGURE of the drawing represents a central axial section through the embodiment, with the paint supply tube broken off and without the bell drive.

DETAILED DESCRIPTION OF THE PREFERRED EMBODIMENT

A rotatable atomiser bell (10) substantially in the form of a body of revolution and having a rotationally symmetrical deflecting member (28) of the device according to the invention inserted axially from the front comprises a bottom part (12) in the form of a circular disc having a central opening in the form of an axial bore (14) which widens out convexly in the front and the axis of which determines the axial of the bell (16); a conical ring (18) extending obliquely forwards along the axis from the edge of the base (12) and diverging forwards in the axial direction, i.e. to the left in the FIGURE; and an axially forwardly projecting lip (20) in the form of a circular ring continuous with the ring (18).

At its axially front end face, the atomizer bell (10) has an annular, coaxial overflow surface (24) which is concave in cross-section approximately in the form of a circular arc elongated in the radical direction towards the centre, the radially inner edge of which is connected to the axially front end of the bore (14) by way of an annular, coaxial transition surface (26). The axially rear base part (26.1) of this transition surface partly lies in radial planes and comprises the base (26.1.1) of the bell (10), which base lies in a radial plane in the bottom (12) of the bell, followed by a conical base surface (26.1.2) which diverges forwards in the axial direction and a shoulder (26.1.3) which also lies in a radial plane and forms the front boundary of the bottom, so that the base (26.1.1), the diverging bottom surface (26.1.2) and the shoulder (26.1.3) form an obtuse angled step in cross-section with two rounded off edges. Corresponding to this obtuse angled step is another axially centered rear surface (29) which has almost the same cross-section but its central part, which lies in a radial plane axially opposite the base (26.1.1) and the bore (14), has a sharp deflecting edge (28.1). Going back to the end face of the atomizer bell, its axially forwardly diverging conical surface situated in the axially front part (26.2) of the gap and also centered on the axis (16) forms the radially inner side of the bell ring (18) which is composed of a rear part (18.1) which diverges axially forwards at a relatively small angle and a front part (18.2) which diverges axially forwards at a greater angle, namely almost radially.

The atomizer bell (10) has a deflecting member (28) which is almost in the form of a double trapezium in central longitudinal section. Its concave, axially front surface (30), which is only slightly conical, i.e. almost lies in a radial plane, is slightly spaced apart from and flush with the radially inner part (24.1) of the overflow surface (24) of the bell (10). This radially inner part of the overflow surface faces forwards in the axial direction and also lies almost in a radial plane. The axially rear surface (29) of the deflecting member and the radially outermost conical boundary surface (31) which diverges axially forwards in the same manner as the ring part (18.1) cooperate with the stepped transition surface (26) of the bell, which is bent off at an angle at the boundary surface (31), to form a chamber (32) in the form of a gap which has a predominantly constant width of, preferably, 0.5 to 0.7 mm and which forms an annular gap (34) in the radial position between the overflow surface (24) and the transition surface (26). The gap (32) is shown in the FIGURE to conform to the complementary profile steps of the rear part (26.1) of the transition surface (26) and the rear surface (29) in forming a bent channel the beginning section of which expands radially inwards where the bore (14) of the bell is situated while the end section is bent off at an angle at the gap (34). The deflecting member (28) is held by spacers (36), one at each of at least three positions uniformly distributed about the axis (16), each of which spacers is formed by the external collar of a cylindrical sleeve (37) arranged parallel to the axis and is clamped between the rear surface (29) of the deflecting part (28), which is this region lies in a radial plane, and the shoulder (26.1.3) of the rear part (26.1) of the transition surface (26), each sleeve (37) holding a screw (56) which has its shank screwed into the bell (10) and is also screwed into the deflecting member (28) (axially from the rear).

The radially outer part (24.2) of the overflow surface (24) of the bell (10) faces radially inwards and ensures that the different streams of paint which come together in the gap (34) are deflected in a direction parallel to the axis in the front part (26.2) of the transition surface and on the front surface (30) after having spread out in the radial direction.

The deflecting member (28) contains an insert (38) on its rear surface facing the bottom (12) of the bell. This insert is accommodated in a recess (40) extending through to the front of the deflecting member. The component of the stream of paint which flows axially forwards through the bore (14) of the bell is partly slowed down by this insert of the recess and deflected to the front surface (30) of the deflecting member (28). For this purpose, the insert (38) is provided inter alia with a blind axial bore (42) which is in axial alignment with the bore (14) and opens at the centre of the base of a sharp edged circular cylindrical recess (43) which is shallow in the axial direction and has a diameter smaller than the main diameter of the bore (14) in the bell.

The atomizer bell (10) has a circular cylindrical extension (48) continuous with the bottom (12) of the bell on its axially rear side. This extension (48) has a screw insert (49) into which the axially front end of a hollow shaft (not shown) can be screwed for rotating the bell (10) about its axis (16). A paint supply tube (45) is mounted coaxially inside the hollow shaft and remains stationary when the atomizer bell (10) is rotated. At its axially front end, this paint supply tube has a centrally situated paint nozzle (51) from which paint is emitted forwards in the axial direction in the form of a narrow conical jet in the bore (14) at the transition to the trumpet shaped end section and directed against the insert (38) seated at the centre of the deflecting member (28).

Part of this paint reaches the circular base of the recess (43) in the insert and is thrown back from there to the nozzle (51) whee the inclined, planar end face (51.1) reflects this paint tangentially to the rounded portion of the front section of the bore (14) while another portion of the paint strikes obliquely against the surroundings of the recess (43) and passes along the rear surface (29) to the edge (28.1) where it is sub-divided due to partly changing over to the opposite transition surface (26) where it combines with the first-mentioned portion of paint which is already flowing on this transition surface. The main stream of paint is thus deflected into the gap (32) from which it passes through the annular gap (34) to the overflow surface (24) to reach the lip (20). The droplets of paint which are mechanically thrown off a spray edge (60) by centrifugal action become electrostatically charged by a charging edge (62) and are transported in the electrostatic field to the article which is required to be painted, for example a motor car body.

The bore (14) in the bottom (12) of the bell is radially increased in width (15) by a step to form a bore (47) in the extension (48) in which an internal thread is formed at the rear for the insertion of a threaded member (49). In this arrangement, several oblique bores (66) distributed round the axis and extending through the extension (48) and through a radially extending annular disc (78) open into the bore (47), the said disc (78) being seated on the threaded insert (49) and containing the screws (56).

A slightly conical jacket (80) which diverges only slightly in the forward direction and is formed in one piece with the lip (20) extends between the radially outer edge of the disc (78) and the lip (20) of the bell (10). This jacket (80) forms the radially outer boundary to an annular cavity (82) which is bounded on its radially inner side by the bell ring (18), the bottom (13) of the bell and the extension (48) and is closed at the rear by the disc (78). Air arriving in the axial direction from the righthand side in the drawing is only caused to diverge slightly by the jacket.

Although only preferred embodiments are specifically illustrated and described herein, it will be appreciated that many modifications and variations of the present invention are possible in light of the above teachings and within the purview of the appended claims without departing from the spirit and intended scope of the invention.

What is claimed is:

1. Device for the atomization of liquid paints, comprising an atomizer bell (10) which is rotatable about a central axis (16) and has an axial opening bore (14) at its base (26.1) and an axially forwardly facing and radially inwardly facing, profiled, annular, coaxial overflow surface (24) whose radially inner edge is connected with the axially front end of the opening by means of a profiled, annular, coaxial transition surface (26) which forms the axially front boundary to the base; and further comprising a coaxial, centrally perforated deflecting member (28) of which the centre of its axially rear surface (29) is situated axially opposite to the front end of the opening in the bell while its radially outer edge cooperates with the bell to form an annular gap (34) which interrupts the transition from an axially front surface (30) of the deflecting member to the overflow surface of the bell, the transition surface of the bell cooperating with the axially rear surface and the radially outer surface (31) of the deflecting member to form the boundaries of a chamber (32) in the form of a gap between the bell and the deflecting member, which chamber has only localized interruptions in the form of spacers (36) between the bell and the deflecting member, characterized in that the axially rear surface (29) of the deflecting member (28) and the base part (26.1) of the transition surface (26) facing said rear surface (29) have each an obtuse angled step in cross-section, which step is so arranged, while preserving the gap (32), that in a middle section (at 26.1.2) the paint in this gap flows both axially forwards and radially outwards; and in that the axially rearwardly projecting centre of the axially rear surface (29) of the deflecting member (28) is bounded at its radially outer region by a sharp deflecting edge (28.1) of the step of this rear surface (29) while the other bends in the cross-sections of the two complementary steps are rounded off.

2. Device according to claim 1, comprising a nozzle (51) which has a plane end surface (51.1) and produces a narrow conical jet, the axially front end of which nozzle extends coaxially into the opening at the base (26.1) of the bell, which opening is in the form of a bore (14) which widens out convexly in cross-section in the axially forward direction, characterized in that the centre of the axially rear surface (29) of the deflecting member (28) has a circular, preferably sharp edged recess (43) the axial length of which is substantially less than its diameter; and in that the end face (51.1) of the nozzle (51) makes an angle other than a right angle with the central axis (16), preferably an angle of 75°.

3. Device according to claim 1, in which the atomizer bell (10) has a base (12) with an axial opening (14), which base comprises the base part (26.1) of the transition surface (26) and is continuous with a ring (18) containing the gap part (26.2) of the transition surface (26), and an annular lip (20) containing the axially most forwardly directed and radially most outwardly directed part (24.2) of the overflow surface (24), characterized in that an axially rearwardly directed and rearwardly slightly converging conical jacket (80) is formed on the lip (20) to end axially behind the base (12).

4. Device according to claim 2, in which the atomizer bell (10) has a base (12) with an axial opening (14), which base comprises the base part (26.1) of the transition surface (26) and is continuous with a ring (18) containing the gap part (26.2) of the transition surface (26), and an annular lip (20) containing the axially most forwardly directed and radially most outwardly directed part (24.2) of the overflow surface (24), characterized in that an axially rearwardly directed and rearwardly slightly converging conical jacket (80) is formed on the lip (20) to end axially behind the base (12).

* * * * *